United States Patent [19]

Ohminato

[11] 4,449,840

[45] May 22, 1984

[54] BINDER ASSEMBLY OF THE RING TYPE

[75] Inventor: Kiyoshi Ohminato, Tokyo, Japan

[73] Assignee: King Jim Co., Ltd., Japan

[21] Appl. No.: 509,593

[22] Filed: Jun. 30, 1983

Related U.S. Application Data

[63] Continuation of Ser. No. 185,758, Sep. 10, 1980, abandoned.

[30] Foreign Application Priority Data

Dec. 27, 1979 [JP] Japan ..... 54-182451[U]

[51] Int. Cl.[3] ..... B42F 3/04

[52] U.S. Cl. ..... 402/34; 402/41

[58] Field of Search ..... 402/34, 38, 41

[56] References Cited

U.S. PATENT DOCUMENTS 4,130,368 12/1978 Jacoby et al. ..... 402/41

FOREIGN PATENT DOCUMENTS

| | | | |
|---|---|---|---|
| 69849 | 9/1949 | Denmark | 402/34 |
| 603633 | 4/1926 | France | 402/34 |
| 8005663 | 7/1981 | Netherlands | 402/34 |
| 515 | of 1896 | United Kingdom | 402/34 |

*Primary Examiner*—Paul A. Bell

*Attorney, Agent, or Firm*—Cantor and Lessler

[57] ABSTRACT

A binder assembly of the ring type according to the invention comprises a slide support member, an operable slide member, fixed holder rods and a turnable holder rod. The free ends of these rods are curved in the face-to-face relation to each other. The slide member is fitted into an angle guide portion of the slide support member. The turnable holder rod has a U-shaped portion allowed to engage a space formed in the slide member by way of a through-hole provided in the central lower end of the angle guide portion.

2 Claims, 5 Drawing Figures

BINDER ASSEMBLY OF THE RING TYPE

This application is a continuation, of application Ser. No. 185,758, filed Sept. 10, 1980 now abandoned.

BACKGROUND OF THE INVENTION

The present invention is concerned with improvements in or relating to a binder assembly of the ring type.

In filing a number of papers or documents, printed matter, catalogues and the like, it is well known in the art to use a ring type binder comprising a turnable holder rod and fixed holder rods with the free ends being curved in a face-to-face relationship with each other and designed such that when a great deal of papers or documents are held therein, the holder rods together take a large semicircular form so as to assure a wider spread, and when the binder is closed, they are connected at the centers thereof with each other to form a large ring. However, this type of the binder is less valuable thanks to the complicated mechanism for turning and locking of the turnable holder rod.

SUMMARY OF THE INVENTION

A main object of the present invention is therefore to provide an improved binder assembly which has advantages over the prior art binder that handling and turning of the turnable holder rod are easily and surely achieved with a relatively simple structure.

According to the present invention, this object is attained by provision of a ring binder assembly comprising a slide support member, an operable slide member, and fixed holder rods and a turnable holder rod with their free ends being curved in a face-to-face relation to each other, said slide member being fitted into an angle guide portion of the slide support member; and said turnable holder rod having a U-shaped portion permitted to be in engagement with a space formed in the slide member through a through-hole provided in the central lower end of the angle guide portion.

Preferably, the space to engage the U-shaped portion of the turnable rod is defined by a step section, a tapered section and a lower keep section.

Other objects and advantages of the present invention will become apparent from a reading of the following description with reference to the accompanying drawings, in which.

DETAILED DESCRIPTION OF THE PREFERRED EMBODIMENT

Figure 1:
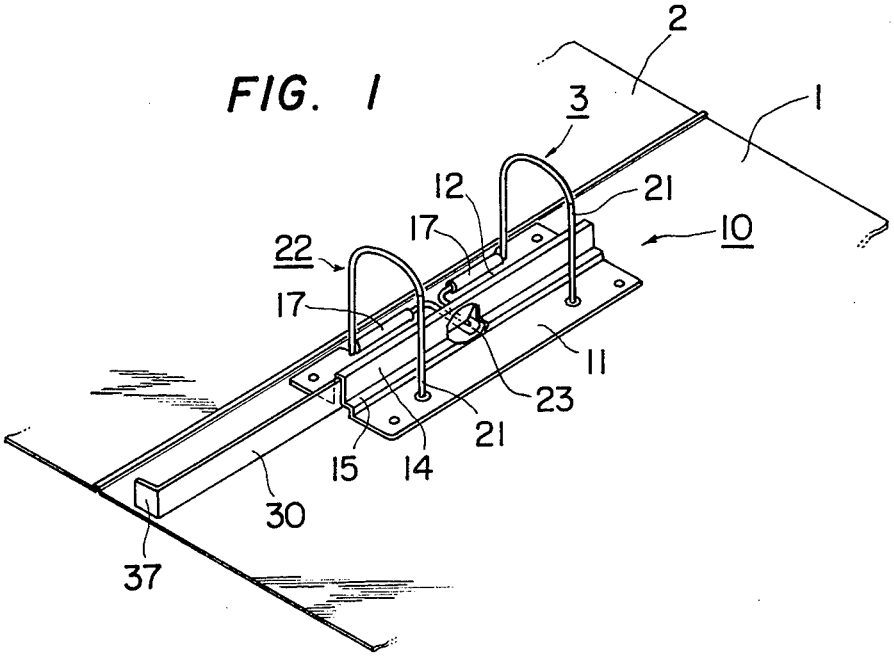
FIG. 1 is a perspective view of the binder assembly according to the present invention in a closed state.
Figure 2:
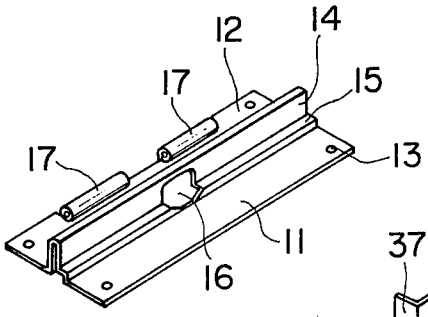
FIG. 2 is a perspective view of the slide support member.

Referring now to FIG. 1 illustrating the binder assembly, generally shown at 3, according to the present invention in a closed state, the binder 3 is fixed on a cover 1 of a file. Reference numeral 2 here stands for the backbone or spine of the file. In one preferred embodiment, the binder 3 comprises a slide support member 10 and a slide member 30 in operable association therewith. The slide support 10 is provided on its one side with a pair of fixed holder rods 21 having their free ends slightly bent toward the spine, and is rotatably provided on the other side with a turnable holder rod 22 having its both ends bent toward the free ends of the fixed rods, as will be described later. As best shown in FIG. 2, the slide support 10 is formed by bending a single metal plate, and has right and left side plates 11 and 12 as well as a guide portion 14 which is angularly bent at the center. The side plate 11 is provided therein with small holes 13 adapted for use in the fixation thereof to the cover of the file, whereas the side plate 12 is provided thereon with rounded hollow sections 17 through which the turnable rod 22 is rotatably inserted. On the boundary between the angle guide portion 14 and the side plate 11 there is a step section 15 for receiving a lateral plate extending from the slide member to be discussed later. The angle guide portion 14 is provided in the central lower end with a through-hole 16 for receiving therein the central U-shaped portion 23 of the turnable rod 22.

Figure 3:
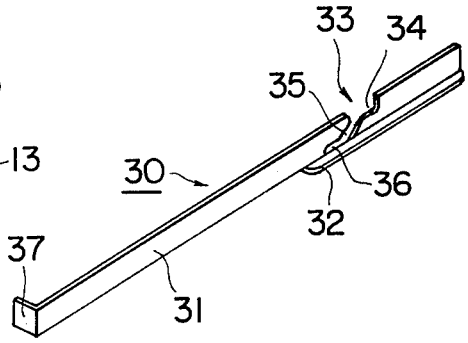
FIG. 3 is a view illustrative of the slide member.

FIG. 3 shows the configuration of the operable slide member 30 fitted into the angle guide portion 14 of the slide support 10. The operable slide member 30 is formed by folding a single metal plate, and includes a lateral plate 32 and an upright plate 31 with its foremost end being bent at a right angle to form a finger grip 37. The upright plate 31 is provided in the central portion with a space 33 defined by an upper step section 34, an intermediate tapered section 35 and a lower keep section 36 as viewed in the opposite direction of the finger grip 37. As illustrated, the section 35 is tapered downwards in the direction of the finger grip 37.

Figure 4:
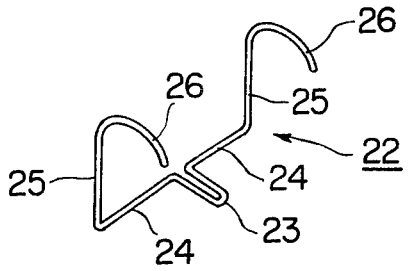
FIG. 4 is a perspective view of the turnable holder rod.
Figure 5:
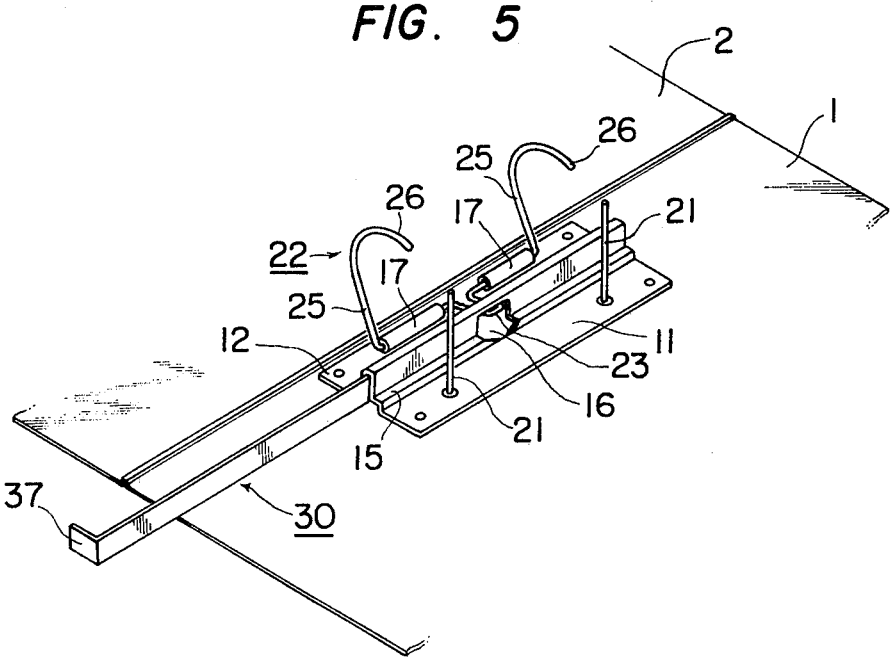
FIG. 5 is a perspective view of the binder assembly in an opened state.

FIG. 4 shows the configuration of the turnable holder rod. As shown, the turnable holder rod 22 has a U-shaped portion 23 extending horizontally at its central lower end, horizontal support portions 24 located on the left and right sides thereof, and upright portions 25 extending upwards with the ends 26 being curved. FIG. 5 shows the binder assembly in an opened state achieved by pulling down the slide 30 and turning the holder rod.

In what follows, the construction and operation of the binder assembly according to the present invention will be explained with reference to the drawings.

The operable slide 30 is inserted into the angle guide portion 14 of the slide support 10. The lateral plate 32 of the slide 30 is received in the step portion 15 located at the lower end of the guide portion 14, and is thus slidingly supported in the guide portion.

The turnable holder rod 22 has the horizontal support portions 24 passed through the rounded hollow sections 17 formed on the side edge of the side plate 12 positioned on the spine side, and has the U-shaped portion 23 permitted to engage the space 33 in the operable slide 30 by way of the through-hole 16 provided in the lower end of the angle guide portion 14. When the operable slide 30 is forced into the angle guide portion 14 by giving a push to the finger grip 37 of the slide 30, the U-shaped portion 23 of the turnable rod 22 goes down along the tapered section 35, rotates in the clockwise direction in FIGS. 1 and 5, reaches the lower keep section 36, and is locked thereon. Thus, since the U-shaped portion 23 rotates in the clockwise direction, the overall turnable rods 22 also turn in that direction until the curved ends 26 come in contact with the fixed holder rods, whereby the binder is closed. On the contrary, when the operable slide 30 is drawn out of the angle guide 14 by giving a pull thereto in the direction of the finger grip 37 as shown in FIG. 5, the U-shaped portion 23 of the turnable holder rod leaves the keep section of the slide 30, turns along the tapered section 35 in the counterclockwise direction and reaches the step section 34. As a result, the overall turnable rod also rotates in that direction, so that the binder is released. It will be understood that if the U-shaped portion 23 catches on the step section 34, then the operable slide 30 is not drawn any more.

As will be understood from the foregoing, the present invention provides an improved ring type binder assembly which is easy to operate in a relatively simple manner, and permits ready and sure opening and closing or locking of the turnable holder rod.

What is claimed is:

1. A binder assembly of the ring type comprising a slide support member, an operable slide member, fixed holder rods and a turnable holder rod having a pair of spaced apart free ends, with said free ends being arranged in a face-to-face relation to the free ends of the fixed holder rods; said slide support member having a longitudinal upright angle guide portion centrally disposed therein and a longitudinal step section on one side thereof; said slide member comprising a keep formed by a lateral base plate, and an upright plate having a cam opening, the cam opening comprising an upper horizontal step section, a central inclined ramp section, and a lower horizontal keep section; said slide member being fitted into said slide support member with said upright plate disposed in said upright angle guide portion and said base plate disposed in said step section; and said turnable holder rod having a central U-shaped essentially horizontally disposed follower portion in engagement with said cam opening by way of a through-hole provided in the central lower end of the upright angle guide portion;

said slide support member being a unitary metal plate comprising said upright angle guide portion and a pair of bottom flat side plates extending outwardly therefrom, one of said side plates containing a pair of hollow pivot portions for pivotally mounting said turnable holder rod, and the other of said side plates containing said step section adjacent said angle guide portion for receiving said keep on said slide member.

2. A binder assembly of the ring type as recited in claim 1, wherein said turnable holder rod is a unitary wire member being bent to form said central U-shaped portion, a pair of horizontal support portions extending outwardly from said central portion, and an upright portion at the end of each horizontal support portion, said upright portions forming curved upper ends, said horizontal support portions being pivotally mounted in rounded hollow sections on said slide support member.

* * * * *